US007234264B2

(12) United States Patent
Cole

(10) Patent No.: US 7,234,264 B2
(45) Date of Patent: Jun. 26, 2007

(54) DEVICE TO PROTECT A GUN BARREL END

(76) Inventor: Christopher N. Cole, P.O. Box 1515, Clatskanie, OR (US) 97016

( * ) Notice: Subject to any disclaimer, the term of this patent is extended or adjusted under 35 U.S.C. 154(b) by 0 days.

(21) Appl. No.: 11/148,668

(22) Filed: Jun. 8, 2005

(65) Prior Publication Data

US 2006/0277812 A1 Dec. 14, 2006

(51) Int. Cl.
*F41A 35/04* (2006.01)

(52) U.S. Cl. ..... 42/96; 42/90; 42/106

(58) Field of Classification Search ..... 42/90, 42/95, 96, 129, 143; 89/30, 31; 43/136
See application file for complete search history.

(56) References Cited

U.S. PATENT DOCUMENTS

| | | | | |
|---|---|---|---|---|
| 2,385,051 | A * | 9/1945 | Berlin et al. | 89/31 |
| 2,545,473 | A | 3/1951 | Kremkau | |
| 2,558,792 | A * | 7/1951 | Snowden | 42/96 |
| 2,607,147 | A * | 8/1952 | Lampe | 42/96 |
| 3,063,184 | A * | 11/1962 | Sukala, Jr. | 42/96 |
| 3,354,569 | A | 11/1967 | Kassabian | |
| 3,455,047 | A | 7/1969 | Hoag | |
| 3,593,451 | A | 7/1971 | McDonnell | |
| 3,849,923 | A | 11/1974 | Hawkins | |
| 4,084,340 | A | 4/1978 | Scudder | |
| D271,126 | S | 10/1983 | Doak | |
| 4,817,322 | A | 4/1989 | Dietz et al. | |
| 5,105,571 | A | 4/1992 | Kinchin et al. | |
| 5,813,392 | A * | 9/1998 | McCaslin | 124/73 |
| 6,185,862 | B1 * | 2/2001 | Nelson | 43/136 |
| 6,320,093 | B1 * | 11/2001 | Augustine et al. | 602/41 |
| 6,516,550 | B1 * | 2/2003 | Schnyder et al. | 42/96 |
| 6,580,012 | B1 * | 6/2003 | Augustine et al. | 602/42 |
| 2005/0183321 | A1 * | 8/2005 | Brown | 42/96 |

FOREIGN PATENT DOCUMENTS

WO WO 3095929 A1 * 11/2003

* cited by examiner

*Primary Examiner*—Michael J. Carone
*Assistant Examiner*—Bret Hayes
(74) *Attorney, Agent, or Firm*—Kurt M. Rylander; Rylander & Associates

(57) ABSTRACT

A gun muzzle cover includes a washer portion having an adhesive side and a transparent cover portion attached to said washer portion. A muzzle cover provided with a removable slick for packaging and transport. A muzzle cover kit includes a removable slick, one or more muzzle covers removably adhered to said slick, a cleaning pad with a prepping agent, and container to house the kit.

12 Claims, 1 Drawing Sheet

DEVICE TO PROTECT A GUN BARREL END

FIELD OF THE INVENTION

The present invention relates to weapon accessories. More particularly, the present invention relates to devices and methods for protecting and shielding the barrel end of guns.

BACKGROUND

Many people own and use guns for various activities such as hunting, protection, skeet shooting, target practice, among others. Using a gun in the outdoors, particularly a rifle, opens the gun barrel to dust, moisture, dirt, and other foreign materials. Unwanted foreign materials and moisture can affect performance and safety. Before now, gun users have had to rely on tape for protection which is messy and unreliable. Thus, there is a need for a device that protects a gun barrel from dust and moisture without affecting accuracy or performance.

Presently known art attempts to address this problem, but has not completely solved the problem. The following represents a list of known related art:

| Reference: | Issued to: | Date of Issue: |
|---|---|---|
| 3,455,047 | Hoag | Jul. 15, 1969 |
| 5,105,571 | Kinchin et al. | Apr. 21, 1992 |
| 4,817,322 | Dietz et al. | Apr. 4, 1989 |
| 4,084,340 | Scudder | Apr. 18, 1978 |
| 3,849,923 | Hawkins | Nov. 26, 1974 |
| 3,593,451 | McDonnell | Jul. 20, 1971 |
| 3,354,569 | Kassabian | Nov. 28, 1967 |
| 3,063,184 | Sukala, Jr. | Nov. 13, 1962 |
| 2,545,473 | Kremkau | Mar. 20, 1951 |
| Des 271,126 | Doak | Oct. 25, 1983 |

U.S. Pat. No. 3,455,047 to Hoag teaches a "Scotch Tape" muzzle cover where the tape is cut into a generally disk shape, with adhesive either generally applied on one side, or applied in a ring fashion, and then taped to the muzzle.

The teachings of each of the above-listed citations (which does not itself incorporate essential material by reference) are herein incorporated by reference. None of the above inventions and patents, taken either singularly or in combination, is seen to describe the instant invention as claimed.

SUMMARY AND ADVANTAGES

The device to protect a gun barrel end of the present invention includes a washer portion having an adhesive side and a transparent cover portion attached to said washer portion. A muzzle cover provided with a removable slick for packaging and transport. A muzzle cover kit includes a removable slick, one or more muzzle covers removably adhered to said slick, a cleaning pad with a prepping agent, and container to house the kit.

The device to protect a gun barrel end of the present invention presents numerous advantages, including: (1) protecting the gun barrel from being compromised by unwanted foreign materials and moisture; (2) allows sighting down a barrel with the eye; (3) can be shot through without significantly affecting accuracy or, performance; (4) improvement over "Scotch tape" covers in that "Scotch tape" does not have resistance to ultraviolet and heat and cold as the transparent, not translucent polyester used in the present window; (5) improvement over "Scotch tape" in that a tape cover will wrinkle and stretch affecting opacity, where the present invention, having a foam ring with a transparent polyester window on the ring, allows stretching without affecting opacity and without wrinkling.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
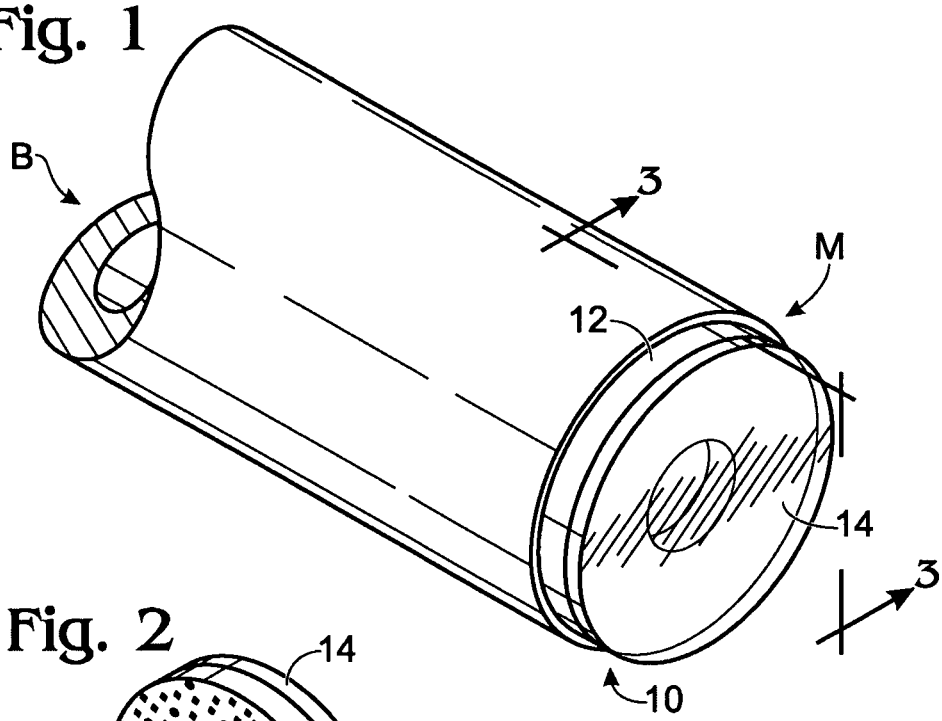
FIG. 1 shows a perspective view of an embodiment of the present invention in use.
Figure 2:
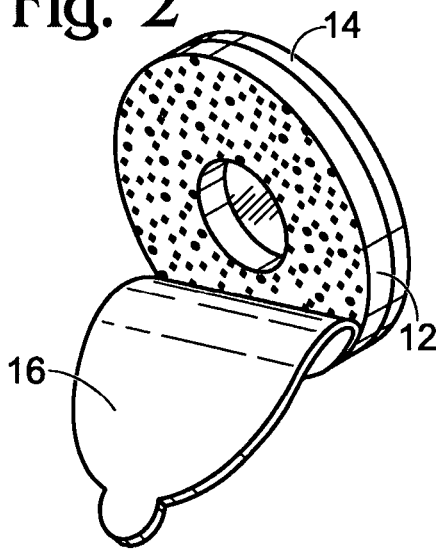
FIG. 2 shows a view of an embodiment of the present invention.
Figure 3:
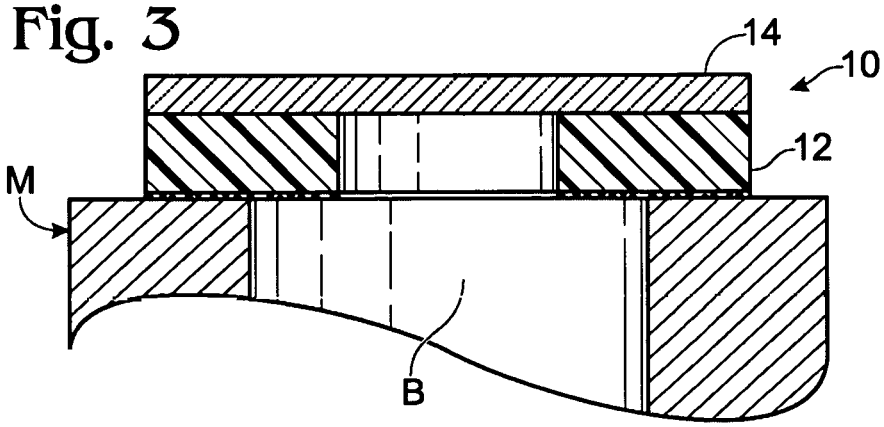
FIG. 3 shows a side slice view of an embodiment in use.

As shown in FIGS. 1-3, a muzzle cover 10 protects a gun barrel end and includes an elastic washer portion 12 adhesively attachable to the muzzle M on a gun barrel B, and a clear transparent cover portion 14 attached to said washer portion. Muzzle cover can be further provided with a removable slick 16 shielding the adhesive side of the washer portion 12.

Elastic washer portion 12 is a circular washer shaped disk, having an inner ring edge with an inner diameter and an outer ring edge with an outer diameter. Elastic washer portion is made of dense weather resistant materials with elastic characteristics allowing the ring to stretch to different type muzzle configurations, 17 caliber to 50 caliber, without significantly affecting the surface tension of the clear transparent cover portion adhered to the washer portion. Elastic washer portion is also coated on both sides with a weather resistant adhesive. Suitable dense weather resistant materials with elastic characteristics, and coated with a weather resistant adhesive, are present in high density double-sided foam tape, as commonly known in the art, and can be purchased, among other places, from Radio Shack as Double-Sided Foam Tap, catalog number 64-2343. In the preferred embodiment, elastic washer portion has an outside diameter across the breadth of the washer, preferably 11/16 in. (17.4625 mm) to 1 in. (25.4 mm). Washer portion has an inside diameter preferably 5/16 in. (7.9375 mm) to ½ in. (12.7 mm). Washer portion is preferably 0.05 in. (1.27 mm) to 0.065 in. (1.651 mm) thick.

Clear transparent cover portion 14 is a clear transparent non-adhesive flexible polyester preferably 0.0381 mm (0.0015 in.) to 0.0762 mm (0.0030 in.) thick. Clear transparent cover portion 14 is adhered to one side of the washer portion 12. As shown in FIGS. 1-3, transparent cover portion 14 covers completely the space defined by the inner ring of the washer portion 12, and covers preferably to the edge of the outer ring of the washer portion 12.

Referring to FIG. 2, removable slick 16 is a coated material, such as wax paper, which removably adheres to the opposite side of the washer portion 12 from which the transparent cover portion 14 is adhered. Removable slick 16 is adhered to washer portion 12 for purposes of packaging and transport. Removable slick 16 is removed from washer portion 12 prior to adhering washer portion 12 to gun barrel B.

In operation in one embodiment, user peels removable slick 16 from adhesive side of washer portion 12, see FIG. 2, and attaches muzzle cover 10 to muzzle end M of a gun, covering the barrel B as shown in FIGS. 1 and 3. Barrel B is thus protected from dirt and grime entering. User can see through the transparent cover portion 14 down into the gun barrel B to check for blockage.

Figure 4:
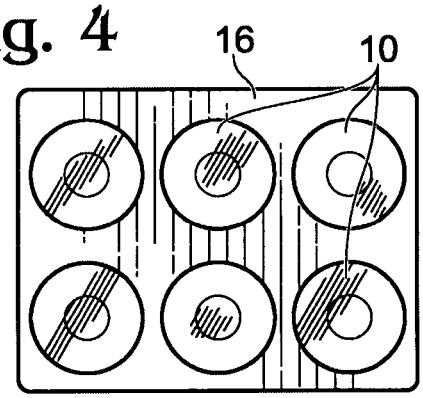
FIG. 4 shows a top down view of an embodiment as packaged

A muzzle cover kit is also provided including one or more muzzle covers 10 removably adhered to a removable slick 16 for transport, see FIGS. 2 and 4, a cleaning pad (not shown) prepared with a prepping agent for cleaning a muzzle gun end, and a container, preferably a plastic bag (not shown), in which the kit is contained. Cleaning pad can be a cloth or paper material soaked in a prepping agent such as rubbing alcohol, or other suitable agent for cleaning the end of a gun preparatory to attaching a muzzle cover.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A muzzle cover, comprising:

an elastic washer portion coated with adhesive;

a clear transparent cover portion adhered to said washer portion; and a gun muzzle upon which said washer portion adheres.

2. The muzzle cover, comprising:

an elastic washer portion having top and bottom sides coated with adhesive;

a clear transparent cover portion adhered to the top side of said washer portion;

a slick removably adhered to the bottom side of said washer portion; and

A gun muzzle upon which said washer portion adheres after removal of said slick.

3. The muzzle cover of claims 1 or 2, wherein said washer portion is a washer shaped disk with an inner diameter in the range of 5/16 in. (7.9375 mm) to ½ in. (12.7 mm) and an outer diameter in the range of 11/16 in. (17.4625 mm) to 1 in. (25.4 mm).

4. The muzzle Cover of claims 1 or 2, wherein said washer portion is in the range of 0.05 in. (1.27 mm) to 0.065 in. (1.651 mm) thick.

5. The muzzle cover of claims 1 or 2, wherein said muzzle cover fits on the end of guns in the range of 17 caliber to 50 caliber.

6. The muzzle cover of claims 1 or 2, wherein said washer portion is made of double-sided foam tape.

7. The muzzle cover of claims 1 or 2, wherein said transparent cover portion is made of a clear transparent non-adhesive flexible polyester.

8. The muzzle cover of claims 1 or 2, wherein said cover portion is in the range of 0.0381 mm (0.0015 in.) to 0.0762 mm (0.0030 in.) thick.

9. A muzzle cover kit, comprising:

a removable slick;

at least one muzzle cover removably adhered to said removable slick, the at least one muzzle cover having an elastic washer portion with top and bottom sides coated with adhesive and a clear transparent cover portion adhered to the top side of said washer portion;

a cleaning pad prepared with a prepping agent for cleaning a muzzle gun end; and a container to house said kit.

10. A covered gun muzzle, comprising:

A gun muzzle;

A cover adhered to said muzzle comprising an elastic washer portion having adhesive on one side adhering said washer portion to said gun muzzle, and a transparent cover portion adhere to the opposide side of said washer portion.

11. A method of covering a gun muzzle, comprising steps of:

Applying adhesive to one side of an elastic washer;

Attaching a clear transparent to another side of said elastic washer; and

Adhering said adhesive applied side of elastic portion to a gun muzzle.

12. A method of covering a gun muzzle, comprising steps of:

Applying adhesive to top and bottom sides of an elastic washer;

Adhering a clear transparent to the top side of said elastic washer; and;

Adhering a removable slick to the bottom side of said elastic washer;

Removing said slick from said bottom side; and

Adhering said bottom side of said of elastic washer to a gun muzzle.

* * * * *